US006146318A

United States Patent [19]

Kuo

[11] Patent Number: 6,146,318

[45] Date of Patent: Nov. 14, 2000

[54] PUSH AND PULL TYPE ROLLER EXERCISER

[75] Inventor: Hui Kuei Kuo, Kaohsiung, Taiwan

[73] Assignees: Chin Tsun Lee; Chun Hsien Wu, both of Tainan, Taiwan

[21] Appl. No.: 09/346,385

[22] Filed: Jul. 1, 1999

[51] Int. Cl.[7] ..... A63B 21/22

[52] U.S. Cl. ..... 482/132

[58] Field of Search ..... 482/95, 96, 127, 482/132, 148

[56] References Cited

U.S. PATENT DOCUMENTS

| | | | |
|---|---|---|---|
| 3,403,906 | 10/1968 | Burzenski | 482/132 |
| 3,616,794 | 11/1971 | Gromala | 482/132 |
| 3,708,164 | 1/1973 | Griffin | 482/127 |
| 3,752,475 | 8/1973 | Ott | 482/127 |
| 4,136,867 | 1/1979 | Wikin | 482/132 |
| 4,339,127 | 7/1982 | Mitchell | 482/132 |
| 5,707,325 | 1/1998 | Chiou | 482/132 |

*Primary Examiner*—Jerome Donnelly
*Attorney, Agent, or Firm*—Charles E. Baxley

[57] ABSTRACT

An exerciser includes a rod laterally secured in a housing and having two ends extended outward of the housing. One or more wheels are rotatably secured in the housing and include a lower portion extended downward beyond the housing for engaging with a supporting surface. A pinion is secured to the wheel. A gear is rotatably secured in the housing and engaged with the pinion. One or more springs are secured between the gear and the housing for recovering the gear and may limit the rotational movement of the gear relative to the housing.

11 Claims, 6 Drawing Sheets

PUSH AND PULL TYPE ROLLER EXERCISER

BACKGROUND OF THE INVENTION

1. Field of the Invention

The present invention relates to an exerciser, and more particularly to a roller exerciser for conducting pushing and pulling exercises.

2. Description of the Prior Art

Typical roller exercisers comprise a wheel rotatably secured on a middle portion of a handle. The users may hold both ends of the handle and push and pull the handle back and forth with the roller wheel. However, the roller wheel is freely and rotatably secured on the handle, such that the handle may not be easily pulled backward by the user and such that the muscle groups of the user may be hurt.

The present invention has arisen to mitigate and/or obviate the afore-described disadvantages of the conventional roller exercisers.

SUMMARY OF THE INVENTION

The primary objective of the present invention is to provide a roller exerciser having a mechanism for limiting the relative rotational movement between the wheel and the housing of the exerciser.

In accordance with one aspect of the invention, there is provided an exerciser comprising a housing, a rod laterally secured to the housing and including two ends extended outward of the housing, at least one wheel rotatably secured in the housing at a pivot shaft and including a lower portion extended downward beyond the housing for engaging with a supporting surface, and means for limiting a rotational movement of the wheel relative to the housing.

The wheel includes a pinion. A gear is rotatably secured in the housing and engaged with the pinion, and means for limiting a rotational movement of the gear relative to the housing.

One or more springs are secured in the housing at a fastener and each includes a first end secured to the housing and each includes a second end secured to the gear for recovering the rotational movement of the gear relative to the housing. The second end of the spring being provided for engaging with the fastener and for limiting the rotational movement of the gear relative to the housing. Two handles are further secured on the ends of the rod.

The rotational movement limiting means for the gear includes a stop device secured to the housing for engaging with the gear and for limiting the rotational movement of the gear relative to the housing. The stop device is pivotally secured to the housing at a pivot pin and includes a leg extended inward of the housing for engaging with the gear and for limiting the rotational movement of the gear relative to the housing. The housing includes a curved slot formed therein for slidably receiving the leg of the stop device and for limiting a rotational movement of the stop device relative to the housing.

A securing device is further provided for securing the stop device to the housing. The housing includes at least one orifice formed therein, the stop device includes a projection biased to engage with the orifice and to secure the stop device to the housing.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
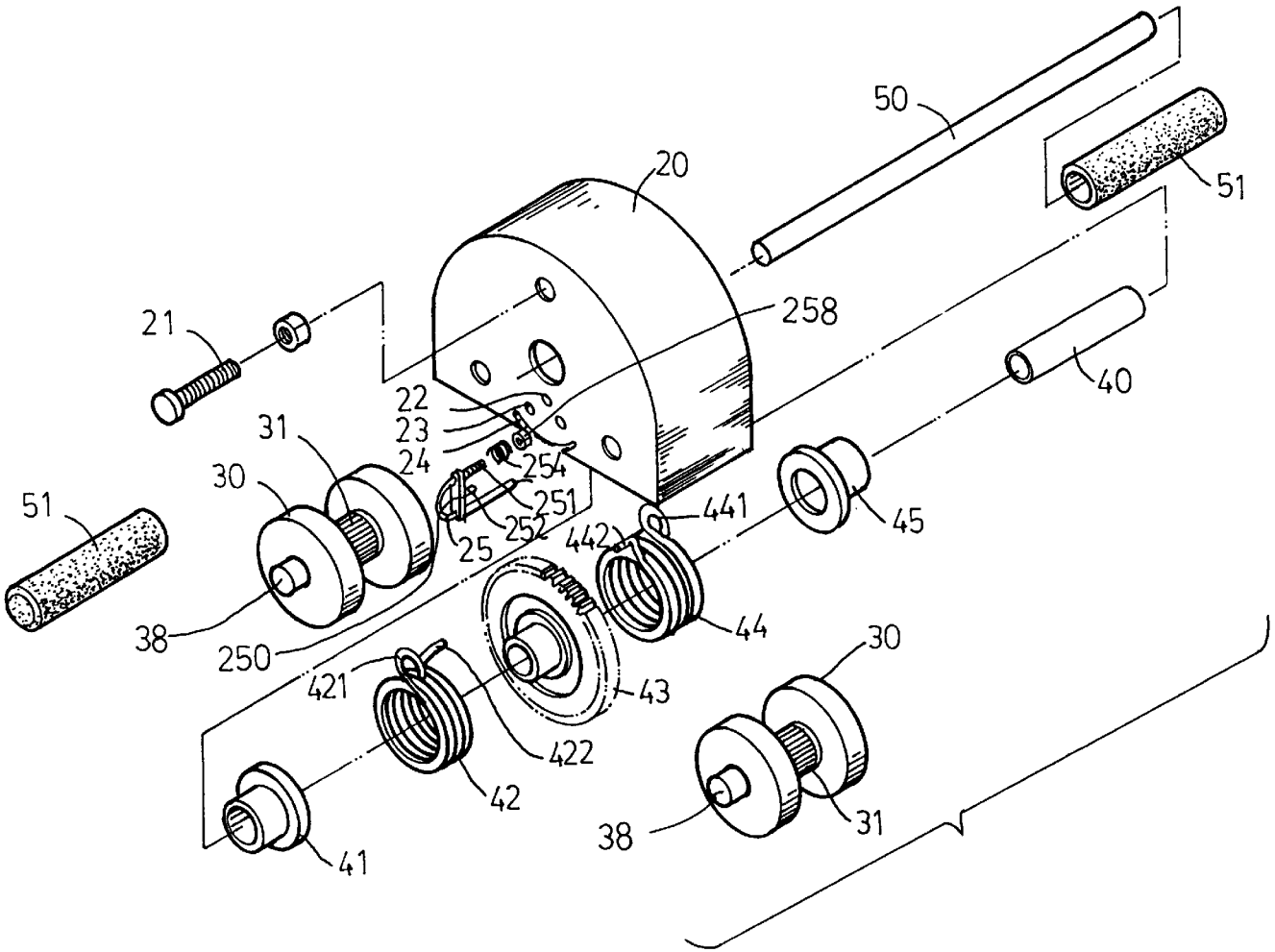
FIG. 1 is an exploded view of an exerciser in accordance with the present invention.
Figure 2:
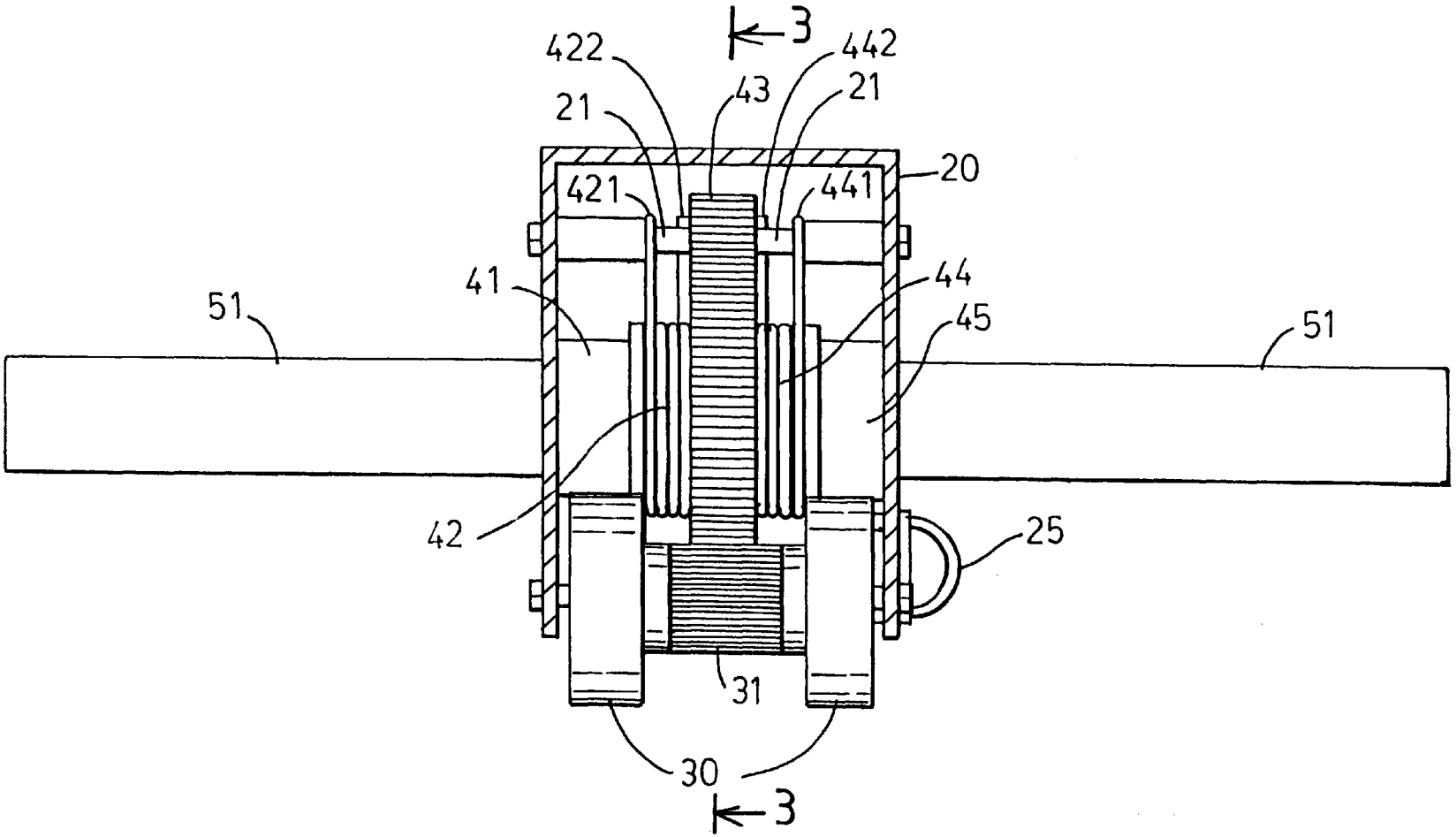
FIG. 2 is a cross sectional view taken along lines 2—2 of FIG. 3.
Figure 3:
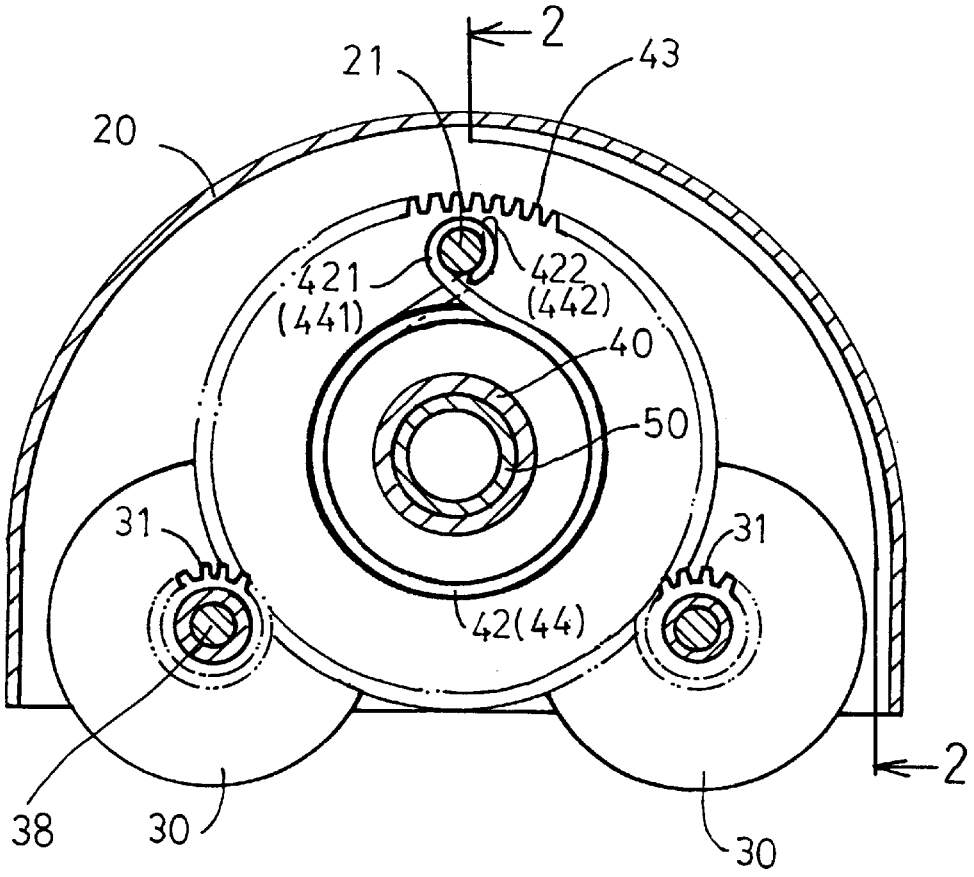
FIG. 3 is a cross sectional view taken along lines 3—3 of FIG. 2.

Referring to FIGS. 1–3, an exerciser comprises a housing 20, a rod 50 rotatably secured in the housing 20 and laterally extended through the housing 20 and having two ends extended outward of the housing 20. A tube 40 is engaged on the middle portion of the rod 50. Two handles 51 are engaged on the ends of the rod 50 and engaged with the housing 20 for rotatably securing the rod 50 to the housing 20 and for preventing the rod 50 from moving laterally relative to the housing 20. Two or more pairs of wheels 30 are rotatably secured in the housing 20 at a respectively pivot shaft 38 and each includes a pinion 31 secured thereon and rotated in concert with each other. The wheels 30 each includes a bottom portion extended downward beyond the housing 20 for engaging with the supporting surface or the ground. A gear 43 is rotatably engaged on the tube 40 and is engaged with the pinions 31 of the wheels 30. Two coil springs 42, 44 are engaged on the tube 40 and disposed on the opposite sides of the gear 43 and each includes one end 421, 441 secured to the housing 20 by a fastener 21 that is extended inward of the housing 20, best shown in FIG. 2. The springs 42, 44 each includes the other end 422, 442 engaged into the gear 43 for applying a spring biasing or recovering force to the gear 43. Two sleeves 41, 45 are engaged on the tube 40 and engaged between the springs 42, 44 and the housing 20 for retaining the springs 42, 44 in place.

Figure 7:
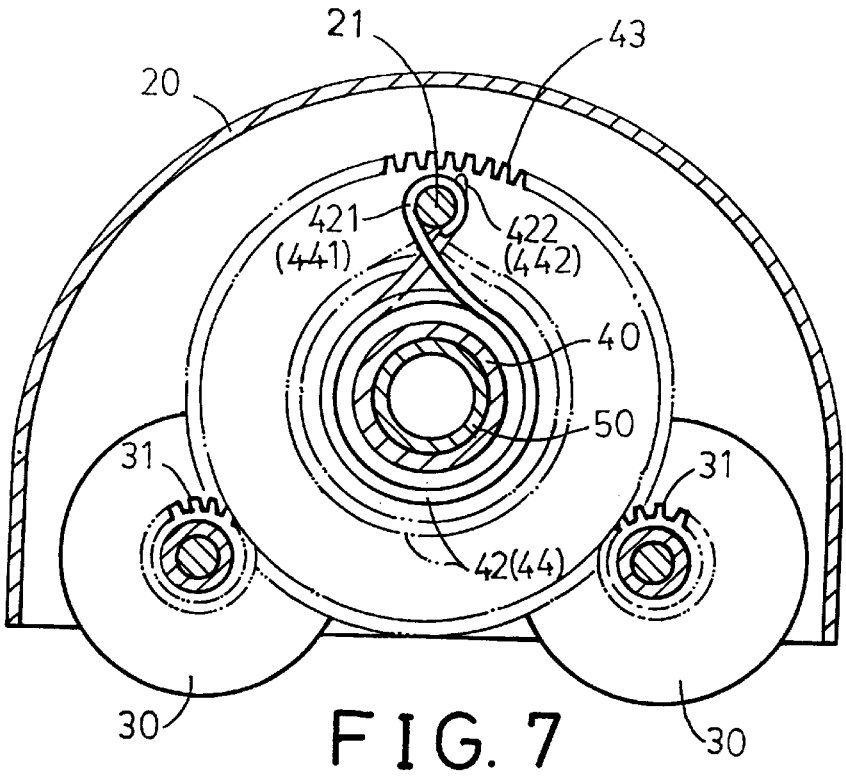
FIGS. 7 and 8 are cross sectional views similar to FIG. 3, illustrating the operation of the exerciser.

In operation, when the user is kneeled down with his knees, for example, and when the user grasps the handles 51, the housing 20 and the wheels 30 may be moved forward and rearward by the user with the handles 51. As shown in FIGS. 2 and 7, the other ends 422, 442 of the springs 42, 44 may engage with the fasteners 21 such that the gear 43 is limited to rotate within 360 degrees by the engagement of the ends 422, 442 of the springs 42, 44 with the fasteners 21. The wheels 30 include a radius greater than that of the pinions 31, and the pinions 31 include a radius smaller than that of the gear 43, such that the gear 43 may rotate for only about 360 degrees when the wheels 30 rotates for more than one round. The arrangements or the changes of the sizes of the wheels 30, the pinions 31, and the gear 43 may be used to determine or to adjust the moving stroke of the handles 51 and of the housing 20.

It is to be noted that the exerciser may comprise a simplified structure including a single wheel 30 and including a pinion 31 for engaging with the gear 43. The movement of the wheel 30 with the supporting surface or the ground may also be used to rotate the gear 43 and the other ends 422, 442 of the springs 42, 44 and may also be used to adjust the moving stroke of the housing 20. A single coil spring 42 or 44 is also good enough to recover the gear 43 relative to the rod 50 and to determine the moving stroke of the housing 20. The user may also move the housing 20 with the rod 50 and without the handles 51. Without the tube 40, the gear 43 and the sleeves 41, 45 may also be directly engaged on the rod 50. The gear 43 may also be pivotally secured in the housing 20 at an additional pivot axle instead of engaging on the rod 50.

Figure 4:
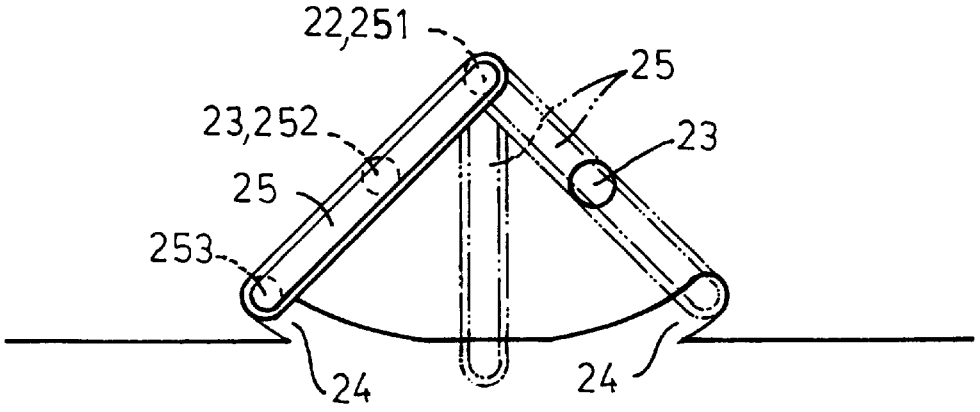
FIG. 4 is a partial plane view showing a stop device of the exerciser.
Figure 5:
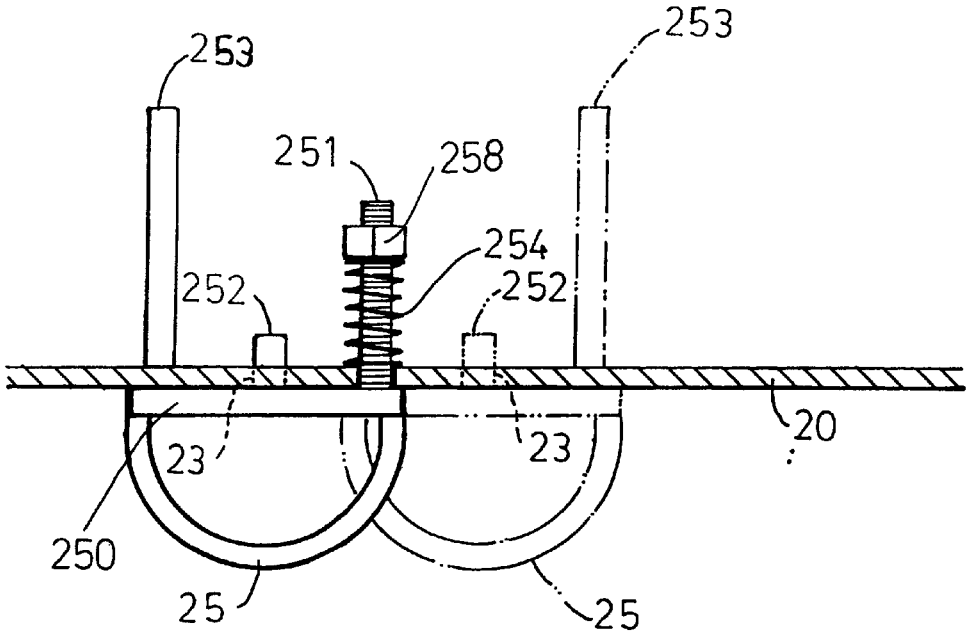
FIG. 5 is a top schematic view of the stop device of the exerciser as shown in FIG. 4.
Figure 6:
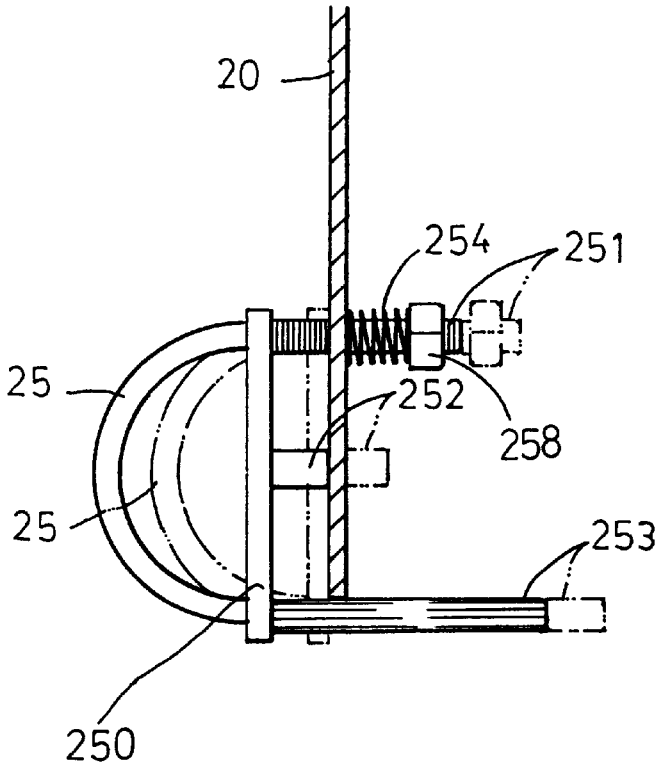
FIG. 6 is a side schematic view of the stop device of the exerciser as shown in FIG. 4.

Referring next to FIGS. 4–6, and again to FIG. 1, a stop device 25 includes a pin 251 rotatably engaged in a hole 22 of the housing 20 for allowing the stop device 25 to rotate about the pin 251 relative to the housing 20. The stop device 25 includes a leg 253 extended through a curved slot 24 of the housing 20 which includes a center of curvature located at the hole 22 and the pin 251, such that the rotational movement of the stop device 25 relative to the housing 20 is limited by the sliding engagement of the leg 253 of the stop device 25 in the curved slot 24 of the housing 20. The housing 20 further includes two orifices 23 formed therein and located between the end portions of the curved slot 24 and the hole 22 of the housing 20. The stop device 25 includes a bar 25 secured therein and having a projection 252 extended therefrom and located between the pin 251 and the leg 253 for engaging with either of the orifices 23 of the housing 20 and for securing the stop device 25 at the selected angular position relative to the housing 20. A fastener 258 is secured on the pin 251 and a spring 254 is engaged between the fastener 258 and the housing 20 for biasing the leg 253 of the stop device 25 inward of the housing 20 and for biasing the projection 252 of the stop device 25 to engage with either of the orifices 23 of the housing 20.

Figure 8:
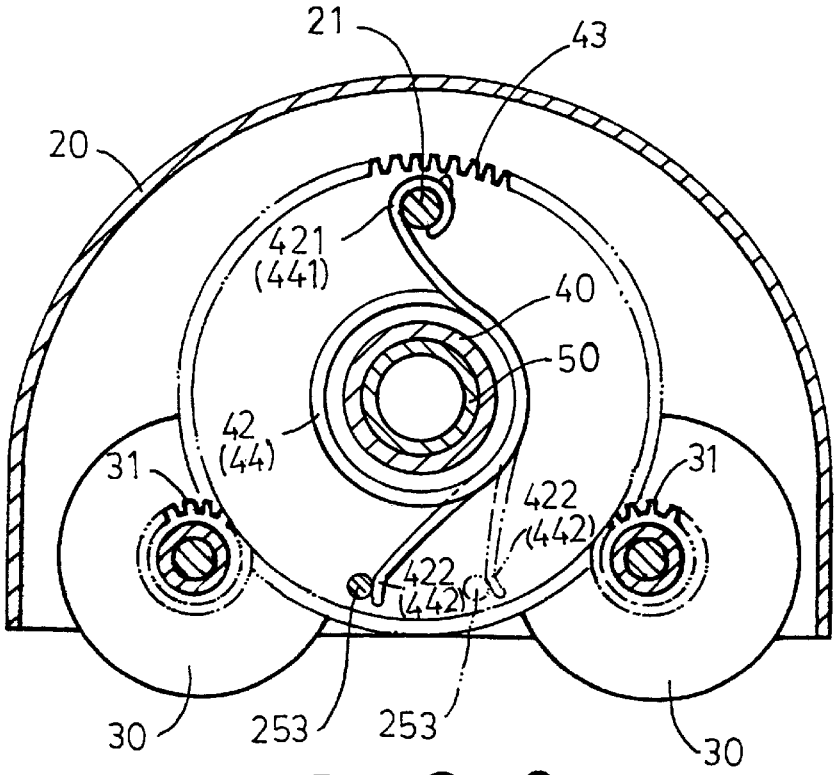

As shown in FIG. 6, when the stop device 25 is pulled outward of the housing 20 against the spring 254, the projection 252 may be disengaged from the orifices 23 of the housing 20 such that the stop device 25 may be rotated relative to the housing 20 about the pin 251 and such that the leg 253 of the stop device 25 may be moved along the curved slot 24 of the housing 20. As shown in FIG. 8, the position of the leg 253 of the stop device 25 may thus be adjusted to the location close to either of the wheels 30. The other end of the springs 422, 442 may engage with the leg 253 of the stop device 25 (FIG. 8) and may thus be used for further adjusting or for determining the rotational movement of the gear 43 relative to the housing 20 and for adjusting the moving stroke of the housing 20 and the rod 50. When the projection 252 of the stop device 25 is not engaged into either of the orifices 23 of the housing 20, the leg 253 of the stop device 25 may thus be slightly pulled outward of the housing 20 and may be moved away from the moving path of the other end 422, 442 of the spring 42, 44, such that the stop device 25 may not be used for limiting the rotational movement of the gear 43.

Figure 10:
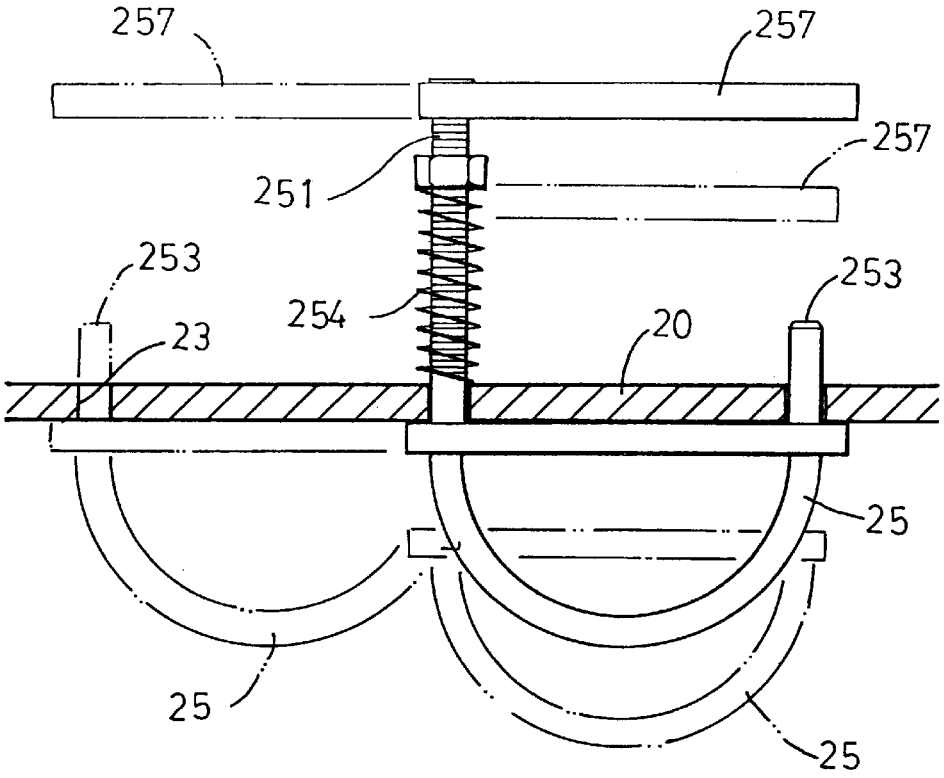
FIG. 10 is a partial top plane view illustrating the operation of the stop device as shown in FIG. 9.
Figure 9:
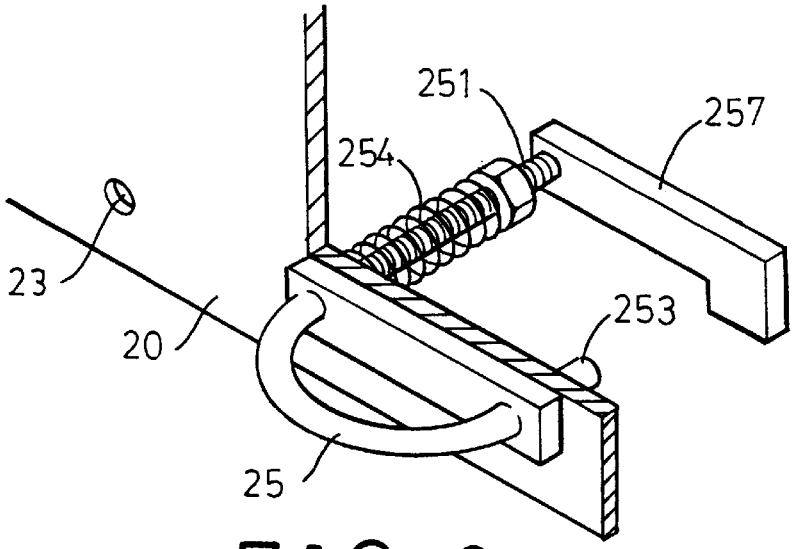
FIG. 9 is a partial perspective view illustrating the other application of the stop device.

Referring next to FIGS. 9 and 10, alternatively, the leg 253 of the stop device 25 may include a length shorter than that of the pin 251. A stem 257 is secured to the pin 251 and rotated in concert with the pin 251 of the stop device 25. The leg 253 may be adjusted to engage with either of the orifices 23 of the housing 20 by pulling the stop device 25 outward of the housing 20 against the spring 254, in order to rotate the stem 257 to different location for engaging with the other end of the springs 422, 442 and thus for limiting the moving stroke of the housing 20.

Accordingly, the exerciser includes a wheel may be limited to rotate relative to the housing.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A exerciser comprising:

a housing, a rod laterally secured to said housing and including two ends extended outward of said housing, at least one wheel rotatably secured in said housing at a pivot shaft and including a lower portion extended downward beyond said housing for engaging with a supporting surface, and means for limiting a rotational movement of said at least one wheel relative to said housing, wherein said at least one wheel includes a pinion secured thereto and rotated in concert therewith said rotational movement limiting means includes a gear rotatably secured in said housing and engaged with said pinion, and means for limiting a rotational movement of said gear relative to said housing.

2. The exerciser according to claim 1 further comprising means for recovering the rotational movement of said gear relative to said housing.

3. The exerciser according to claim 1 further comprising at least one spring secured in said housing at a fastener and including a first end secured to said housing and including a second end secured to said gear for recovering the rotational movement of said gear relative to said housing.

4. The exerciser according to claim 3, wherein said second end of said at least one spring being provided for engaging with said fastener and for limiting the rotational movement of said gear relative to said housing.

5. The exerciser according to claim 2 further comprising two handles secured on said ends of said rod.

6. The exerciser according to claim 1, wherein said rotational movement limiting means for said gear includes a stop device secured to said housing for engaging with said gear and for limiting the rotational movement of said gear relative to said housing.

7. The exerciser according to claim 6, wherein said stop device is pivotally secured to said housing at a pivot pin and includes a leg extended inward of said housing for engaging with said gear and for limiting the rotational movement of said gear relative to said housing.

8. The exerciser according to claim 7 further comprising at least one spring secured in said housing and including a first end secured to said housing and including a second end secured to said gear for engaging with said leg of said stop device and for limiting the rotational movement of said gear relative to said housing.

9. The exerciser according to claim 8, wherein said housing includes a curved slot formed therein for slidably receiving said leg of said stop device and for limiting a rotational movement of said stop device relative to said housing.

10. The exerciser according to claim 9 further comprising means for securing said stop device to said housing.

11. The exerciser according to claim 9, wherein said housing includes at least one orifice formed therein, said stop device includes a projection extended therefrom, and means for biasing said projection to engage with said at least one orifice of said housing and to secure said stop device to said housing.

* * * * *